United States Patent [19]

Temelli

[11] Patent Number: 4,538,529

[45] Date of Patent: Sep. 3, 1985

[54] GARBAGE INCINERATOR

[75] Inventor: Sedat Temelli, Erkrath, Fed. Rep. of Germany

[73] Assignee: Vereinigte Kesselwerke AG, Duesseldorf, Fed. Rep. of Germany

[21] Appl. No.: 631,944

[22] Filed: Jul. 12, 1984

Related U.S. Application Data

[63] Continuation-in-part of Ser. No. 575,046, Jan. 30, 1984, , which is a continuation of Ser. No. 309,129, Oct. 5, 1981, abandoned.

[30] Foreign Application Priority Data

Oct. 15, 1980 [DE] Fed. Rep. of Germany ..... 3038875

[51] Int. Cl.[3] ..... F23G 3/00

[52] U.S. Cl. ..... 110/244; 110/171; 110/203; 110/214; 110/251

[58] Field of Search ..... 110/203, 205, 210, 211, 110/214, 243, 244, 248, 251

[56] References Cited

U.S. PATENT DOCUMENTS

| | | | |
|---|---|---|---|
| 1,536,220 | 5/1925 | Jouclard | 110/251 |
| 2,016,928 | 10/1935 | Lombardi | 110/171 |
| 2,232,556 | 2/1941 | Nichols | 110/251 |
| 2,715,881 | 8/1955 | O'Neil | 110/251 |
| 3,548,759 | 12/1970 | Jung | 110/244 |
| 3,610,179 | 10/1971 | Shaw, Jr. | 110/214 |
| 3,695,192 | 10/1972 | Von Brimer | 110/203 |
| 3,727,565 | 4/1973 | Schoppe et al. | 110/214 |
| 3,834,327 | 9/1974 | Hellstrom | 110/244 |
| 4,027,602 | 6/1977 | Mott | 110/203 |
| 4,123,979 | 11/1978 | Tesch | 110/214 |
| 4,280,417 | 7/1981 | Alexandersson | 110/248 |
| 4,334,484 | 6/1982 | Payne et al. | 110/101 CD |
| 4,378,745 | 4/1983 | Flatland | 110/211 |
| 4,389,979 | 6/1983 | Saxlund | 110/244 |

FOREIGN PATENT DOCUMENTS 1289938 10/1969 Fed. Rep. of Germany .

*Primary Examiner*—Henry C. Yuen
*Attorney, Agent, or Firm*—Michael J. Striker

[57] ABSTRACT

A garbage incinerator comprises a combustion grate, a passage for feeding garbage to be combusted onto the grate, a combustion chamber above the grate, and a flue communicating with the combustion chamber and projecting upwardly therefrom. A nozzle box supplied by a separate blower with compressed air is arranged in the region of the flue and provided with a plurality of nozzles oriented to direct air streams at high speed in at least two directions transverse to each other into the stream of flue gas passing through the flue. Preferably, some of the nozzles are oriented to direct air streams substantially parallel to the wall of the flue, whereas other nozzles are oriented to provide air streams which extend transverse to the direction of the first-mentioned air streams.

24 Claims, 9 Drawing Figures

GARBAGE INCINERATOR

CROSS-REFERENCE TO RELATED APPLICATIONS

This application is a continuation-in-part of application Ser. No. 575,046 filed Jan. 30, 1984, which is a continuation of the application Ser. No. 309,129 filed Oct. 5, 1981, and now abandoned.

BACKGROUND OF THE INVENTION

The present invention relates to garbage incinerators with a combustion chamber and a flue for the flue gas communicating therewith.

The incineration of garbage is connected with considerable difficulties, since the garbage may be of very different composition.

Since a complete combustion is desired, it is among other things necessary to take care of a suitable introduction and distribution of a sufficiently large amount of combustion air, which as a primary, secondary and tertiary air is introduced into the combustion chamber.

Domestic garbage and similar garbage has a very high percentage (about 80%) of volatile components (fumes), which must be subjected to an afterburning under addition of secondary air.

Thereby it is necessary to assure an intensive mixing of the fumes or flue gases with the secondary air, since otherwise only an incomplete combustion would occur.

Such a construction should assure that the flue gases revolve on the inclined surfaces of the incinerator and that thereby the mixing of flue gas and combustion air is favored.

During operation of such installations, it has however proved disadvantage that thereby flue gas detachment whirls are produced and the particles contained therein, which are in pasty condition, will settle at the rear wall inclination of the incinerator to cause considerable baking on the same.

During the incineration of garbage in incinerators efforts have been made to provide for the most possible complete combustion; in order to achieve this, on the one hand the greatest possible amounts of heat should be generated, and on the other hand, the amounts of unburned residues and noxious materials contained therein should be reduced. Inasmuch as garbage contains a considerable portion of volatile ingredients with the heat value up to 80% as compared to other solid fuels, only a partial combustion takes place immediately on the grate of the combustion chamber. Volatile ingredients are first vaporized. These ingredients are burned out in the transition zone between the combustion chamber and the flue. Only a portion of combustion air, or so-called primary air is correspondingly led through the grate of the combustion chamber. Usual combustion air is blown into the incinerator above the grate as secondary air. It is important that flue gases be supplied with the sufficient amount of combustion air uniformly over an entire cross-section of the incinerator.

To obtain such a mixing of fumes and secondary air the combustion chambers in garbage incinerators are usually so constructed that above the degasification zone the upwardly extending flue is restricted at its front and rear wall by non-symmetrically arranged projections and provided with secondary air nozzles arranged beneath these projections. Such an arrangement has been disclosed in German Pat. No. 1,289,938. It has been obtained by this rather costly means that a vortex or turbulence be produced in the stream of flue gas, which turbulence must cause an intensive intermixing of flue gas with secondary air. Nozzles for blowing secondary air for the combustion of volatile combustible ingredients have been usually arranged in the known device on the bottom walls forming the projections, respectively.

In practice, however, serious disadvantages have been found in the above described incinerators. The loosening vortexes formed by secondary air discharged from the nozzles arranged on the inclined noses or projections are loaded with particles highly concentrated in the air. Since an incomplete intermixing of flue gas with secondary air takes place in the transition zone these particles, due to local shortage of oxygen still contain unburned combustible ingredients. Those particles in the above described combustion process of the combustible volatile ingredients have a temperature at which they are in pasty, viscous state. When these particles come into contact with the wall surfaces of the incinerator they form on the upper sides of the projections cakes which, upon cooling of the incinerator, solidify. These cakes in unfavorable instances reach the weight of tons within the period of few months. These cakes must be removed from the surfaces of the incinerator by means of pneumatic hammers, which usually takes a few days or even weeks to do. Furthermore, chippings dropped from those cakes can lead to damaging of the combustion grate.

Owing to the non-symmetrical arrangement of the inwardly extended projections the speed, with which flue gas stream flows within the incinerator, has a speed component directed toward the wall of the flue. Ash entrained in flue gas stream causes at the places of impacts a strong erosive action on the surfaces of the incinerator. Moreover, the walls exposed to such an action in the conventional installations must be renewed in a short period of time.

It has been found practically impossible to distribute secondary air, which is blown into the incinerator through the nozzles arranged on the undersides of the projections, uniformly over the entire eross-section of the transition zone. In the case of the size of the combustion chamber being from 5 to 6 m, an impulse of air streams discharged from the nozzles is not sufficiently large to reach some remote places in the incinerator. Furthermore, it was not possible, for constructive reasons, to arrange the nozzles sufficiently tight or close to each other so that air streams blown from the nozzles could produce an uninterrupted air mist. It has been further discovered that even with a strong overstoichiometrical air supply, locks of carbon monoxide and other non-completely burned-out gases are still formed. These reduced locks of carbon monoxide can, upon contact thereof with the tubular wall of the flue, result in a tube burst. Moreover, the heat output is worsened and the emission of noxious materials into the atmosphere is increased. Air, which does not take part in combustion, loads the heat output because it increases the amount of the heated exhaust air. An insufficient admixture of secondary air with flue gas results in the formation of highly concentrated noxious gases, such as hydrochloric acid and sulfur dioxide, which cause strong local corrosion of the walls of the flue.

SUMMARY OF THE INVENTION

It is an object of the present invention to provide a garbage incinerator not possessed of the above disadvantages of the prior art.

It is another object of this invention to provide an incinerator in which a uniform intermixing of flue gas with secondary air will be ensured.

These and other objects of the invention are attained by a garbage incinerator comprising a combustion grate, inlet passage means for feeding garbage into said combustion grate, wall means forming a combustion chamber above said grate, and an upwardly projecting flue connected to said combustion chamber so that a stream of flue gases passes from said combustion chamber through said flue; and nozzle box means for blowing secondary air streams at high speed into said streams of flue gas, said wall means further including a transition zone between said combustion chamber and said flue, said nozzle box means being positioned within said wall means and in said transition zone, said nozzle box means being provided with blower means for supplying secondary air into said nozzle box means, said nozzle box means extending over the entire width of said combustion chamber and including a plurality of nozzles distributed over the entire length of said nozzle box means and being closely arranged relative to each other, at least some of said nozzles having axes being oriented to direct air streams at high speed in a direction transverse to the stream of flue gases.

The nozzle box means may include at least one side formed with said nozzles, said nozzles being arranged on said side in two rows, the nozzles in said two rows being offset relative to each other so that the distance between adjacent nozzles in each row is at most equal to the diameter of each nozzle.

The wall means may form at the transition zone between said combustion chamber and said flue at least one nose-like protrusion having an upwardly inclined face, and wherein said nozzle box means is arranged adjacent said protrusion and having a first plurality of nozzles oriented to direct air streams at high speed in upward direction along said upwardly inclined face and a second plurality of nozzles oriented to direct air streams at high speed in a direction transverse to said first mentioned streams into said stream of flue gas.

The nozzle box means may be arranged above and adjacent to said inclined face and have a first plurality of nozzles oriented to blow air streams at high speed in downward direction substantially parallel to said inclined face and a second plurality of nozzles oriented to blow air streams at high speed in a direction transverse to said first-mentioned air streams into said stream of flue gas.

The nozzle box means may be annular and be positioned substantially in a plane normal to said upwardly extending flue.

The nozzle box means may have a trapezoidal cross-section and a lower wall substantially normal to said flue and an inner wall extending downwardly and inwardly inclined toward said lower wall.

The nozzle box means may have a trapezoidal cross-section and an upper wall substantially normal to the wall of the flue and an inner wall extending downwardly and inwardly inclined from an inner edge of said upper wall.

The nozzle box means may have a rectangular cross-section having a top wall and a bottom wall substantially normal to the wall of the flue and an inner wall.

Two nozzle box means may be arranged in said transition zone opposite to each other, each of said nozzle box means having a triangular cross-section with one wall abutting against a wall of the flue, and a first and a second plurality of nozzles being provided in other walls of the nozzle box means and oriented to direct air streams at high speed respectively normal to the other walls into the stream of flue gas.

The nozzle box means may comprise at least one hollow body of heat- and pressure-resistant material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
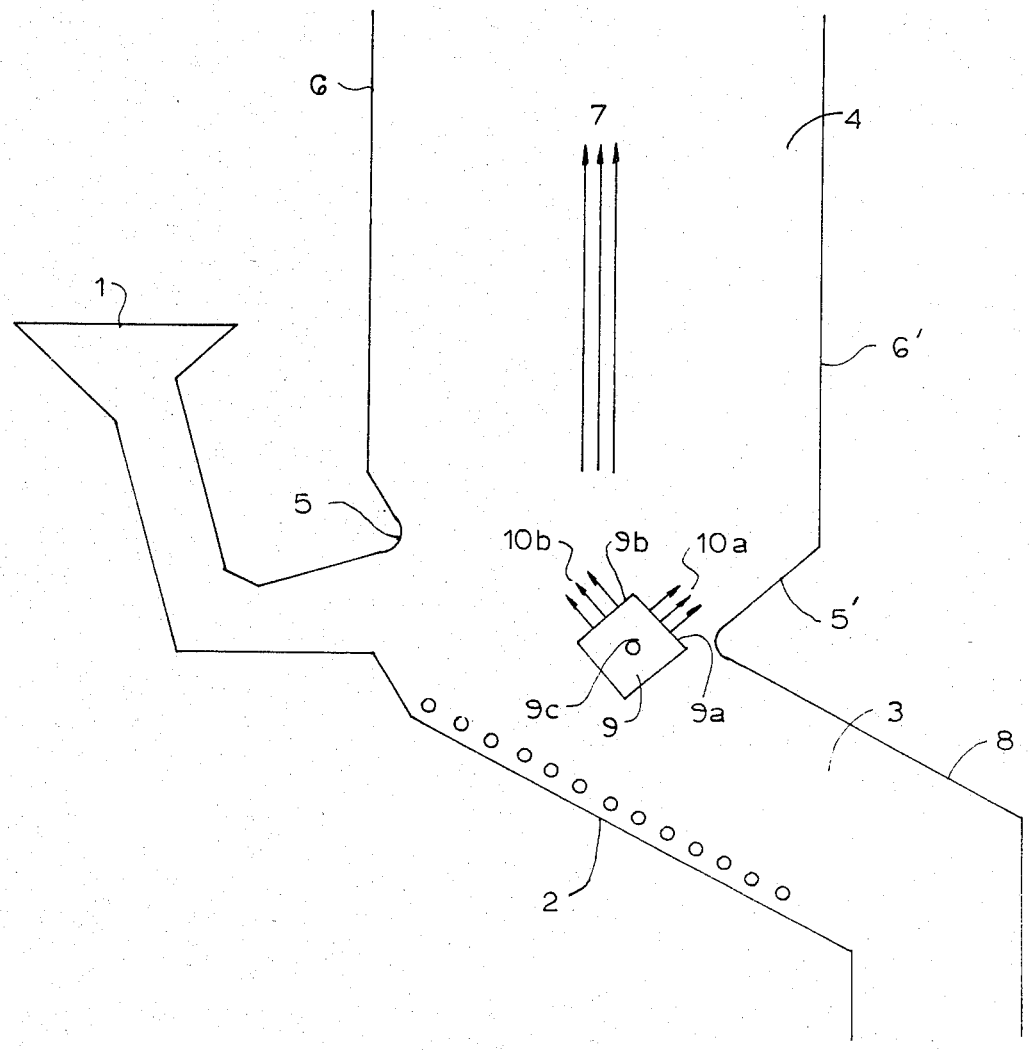
FIG. 1 is a schematic illustration of one embodiment of a garbage incinerator according to the present invention.

FIG. 1 schematically illustrates only those parts of an incinerator which are essential for the present invention. As shown in FIG. 1, the incinerator according to the present invention comprises a garbage inlet 1, to the lower end of which a downwardly inclined combustion grate 2 is connected, so that garbage to be incinerated can be fed onto the grate 2. It is to be understood that primary air, from a source not illustrated in the drawing, is fed in upward direction through the combustion grate and the garbage thereon. A combustion chamber 3 is provided above the combustion grate 2, and a flue 4 extends upwardly from the combustion chamber 3. Combustion chamber 3 is enclosed by walls 8 while flue 4 is enclosed by vertical walls 6. Walls 6, similarly to the walls of the boiler, are formed as heat-exchanger walls. The arrows 7 indicate the flue gas stream passing through the flue.

The transition area between the combustion chamber 3 and the flue 4 is restricted by inwardly extending nose-like shoulders 5, 5'. Shoulders 5, 5' are arranged non-symmetrical relative to each other, so that the shoulder 5 positioned at the side of the garbage inlet 1 is smaller than shoulder 5', lying at the opposite side of the incinerator; shoulder 5 is also positioned vertically higher than the opposite shoulder 5', the inner wall of which smoothly merges into the inclined wall 8 of combustion chamber 3.

A hollow nozzle box 9 of square cross-section is provided in the incinerator. This nozzle box is arranged in the transition zone between combustion chamber 3 and flue 4 so that the diagonals of this square box extend respectively vertically and horizontally. The hollow nozzle box is positioned in the incinerator non-symmetrically, and more specifically it is arranged within the incinerator so that its distance to the larger shoulder or protrusion 5' is substantially smaller than its distance to the smaller shoulder or protrusion 5. Hollow box 9 extends in the horizontal direction over the entire width of combustion chamber 3. Both inclined and upwardly directed sides 9*a* and 9*b* of the box 9 are provided over the whole length of the box with nozzles 10*a*, 10*b*, which are spaced from each other on each respective side of the nozzle box at narrow intervals.

Figure 2:
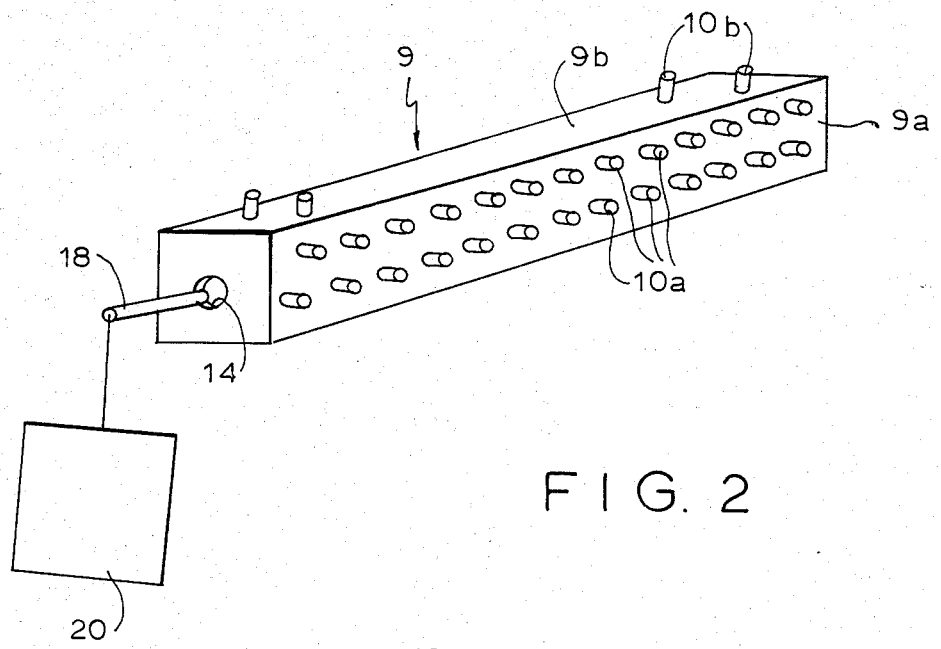
FIG. 2 is a schematic perspective view of a nozzle box according to the present invention.
Figure 3:
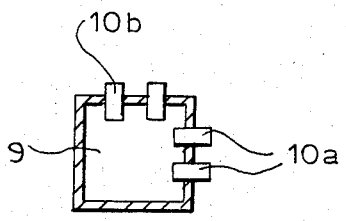
FIG. 3 is a transverse cross-section through the nozzle box shown in FIG. 2.

Hollow nozzle box 9, which is shown in FIGS. 2 and 3 in greater detail, is made out of a heat-resistant steel sheet material. Side surfaces 9*a*, 9*b* are each provided with two parallel rows of nozzles 10*a*, 10*b*, respectively. Only some nozzles 10*b* are shown in FIG. 2 for the sake of clarity.

The nozzle box 9 consists herein of an elongated hollow member of rectangular cross-section with a plurality of tubular nozzles which are arranged spaced from each other in at least two rows on at least one or a plurality of side walls of the box. It is to be understood that the present invention is not limited to a specific shape of the nozzle box, but that also other box shapes, as for instance a hollow body with inclined side walls or annular bent hollow bodies, may be used according to the present invention. The nozzle boxes are preferably manufactured from a heat- and pressure-resistant material.

Nozzles 10*a*, 10*b* are relatively short tubular pieces which are welded into respective bores provided in the side walls 9*a*, 9*b* of the nozzle box.

Nozzles in each row are arranged at the same intervals from each other, and the distance between two neighboring nozzles in each row is not greater than the diameter of each nozzle. Both nozzle rows are offset relative to each other; that is, the nozzles of the upper row disposed on the side wall 9*a* are positioned respectively, above the spaces between the adjacent nozzles of the lower row. An opening 14 is provided at the front side of the hollow nozzle box; a tubular conduit 18 leading from a secondary air blower 20 is connected to opening 14.

Secondary air is blown into the hollow nozzle box 9 through the above mentioned tubular conduit. Air streams are forced from nozzles 10*a*, 10*b* into the interior of the flue gas stream 7. Secondary air is introduced into the box 9 at such a pressure that the air streams emanate therefrom in the direction substantially normal to the respective surface with the speed of at least 40 meters/second. A higher speed of the air streams discharged from the nozzles corresponds to a larger depth of penetration. A large depth of air penetration is in connection with the tightest arrangement of the nozzles so that secondary air passes through the entire cross-section of flue 4. Thereby due to a strong turbulence, and eventually because of high discharge speeds, a thorough intermixing of secondary air with the flue gas takes place. The non-symmetrical position of nozzle box 9 within the incinerator, namely its location in the proximity of the larger shoulder or protrusion 5' provides that crude gas streams are strongly concentrated in the region lying before the tip of protrusion 5' due to the geometry of the combustion chamber, in which region the crude gas or flue gas streams are intensively supplied with secondary air and mixed with the latter.

The above-described embodiment is advisable if the present invention is utilized in the old installation. Since the problem of the distribution of secondary air has been solved by the provision of protrusions or shoulders 5, 5' only incompletely the hollow nozzle box 9 is installed in the incinerator in the above-described manner additionally. This measure can be carried out without any substantial reconstruction works. Very little expenses are required to optimally adjust the position of the nozzle box 9 by rotating it at a small angle about its central axis or by displacing it within the above mentioned transition zone.

In this installation, which normally should have been freed from cakes deposited on the component parts, before changes-over, in intervals of a few months, no cleaning works are required earlier than in three years after a necessary change-over of the parts. The corrosion of the wall surfaces of the incinerator does not take place any longer. Surprisingly it has been discovered that the erosion of the wall surfaces of the incinerator stops beyond the noses or protrusions 5, 5'; this evidently can be explained by the fact that the loosening turbulence within the incinerator is favorably affected by secondary air blown from the nozzle box 9. The amount of stoichiometric air surplus which must lie, before the change-over, within the range of about 2.4 to 2.5, can be reduced to the amount of 1.6 to 1.7, which means that the entire supply of combustion air is reduced to more than 25%. Despite the reduced air supply the content of carbon monoxide in flue gas, after the change-over, is more than ten times less than before.

Figure 4:
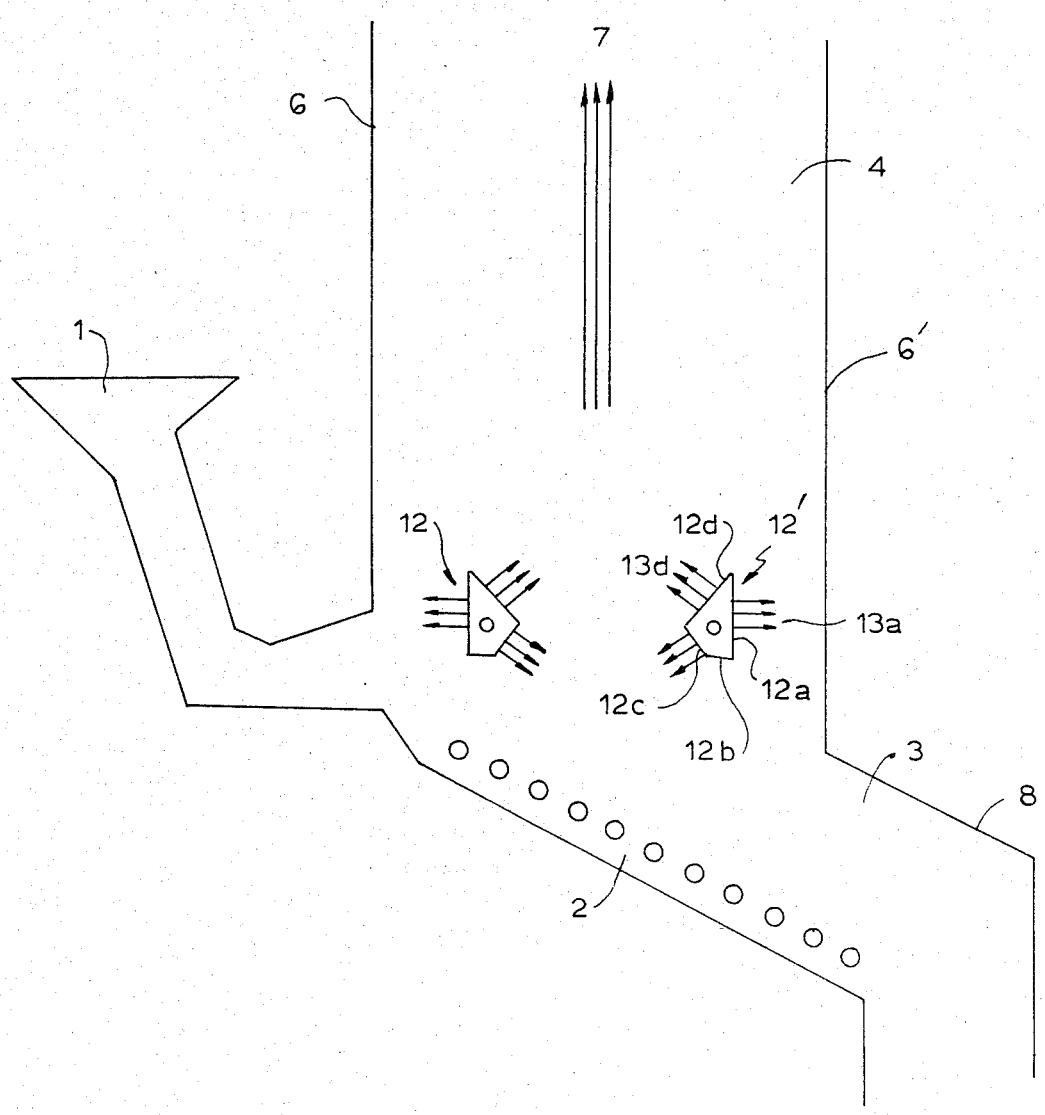
FIG. 4 schematically shows an arrangement of a nozzle box according to another embodiment of the invention.

Referring now to FIG. 4 it will be seen that in another embodiment of the present invention flue 4 is formed by two opposite walls 6 and 6', of which wall 6' extends downwardly beyond wall 6. Both walls 6 and 6' extend smoothly in the downward direction. Two hollow nozzle boxes 12 and 12' are positioned in the enclosed space between walls 6 and 6' in the transition zone between combustion chamber 3 and flue 4. Nozzle boxes 12 and 12' extend, respectively, over the entire width of flue 4 and parallel to each other. Each nozzle box is arranged in the incinerator at a distance from the respective wall 6 or 6' and at a distance from each other. The cross-section of each nozzle box is trapezoidal. Each nozzle box 12, 12' has a respective vertical side wall 12*a* facing the respective wall 6, 6*a*, a horizontal bottom wall 12*b*, a side wall 12*c* inclined downwardly toward bottom wall 12*b* and another side wall 12*d* inclined upwardly toward vertical wall 12*a*. Walls 12*a*, 12*c* and 12*d* are provided over the entire length of each wall with rows of nozzles symbolically indicated by arrows 13*a*, 13*c*, 13*d*. The arrangement of the nozzles in each wall of each nozzle box corresponds to that shown in FIGS. 2 and 3 for the embodiment of FIG. 1. Each nozzle box 12, 12' is provided on its front side with the non-illustrated conventional blower which blows secondary air into each nozzle box.

The arrangement of the nozzle boxes within the incinerator, shown in FIG. 4, is preferable for new installations. Structurally complex and rather expensive protrusions, which have been utilized in conventional installations to form vortexes for a better intermixing of secondary air and flue gas, can be totally omitted. Due to the provision of the nozzle boxes according to the invention and owing to the determined position of the nozzle boxes within the incinerator a uniform and intensive admixture of secondary air with crude gas stream is ensured.

Figure 5:
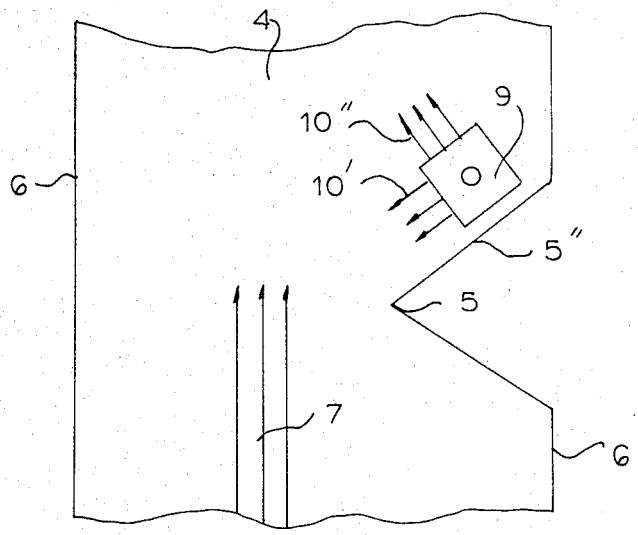
FIG. 5 is a schematic illustration of yet another embodiment of the invention.

In the embodiment shown in FIG. 5, a nozzle box 9 is arranged above the upwardly inclined face 5″ of the flue gas wall 6, so that the air streams 10′ pass downwardly parallel to the face 5″ into the stream 7 of the flue gas, whereas the air streams 10″ pass upwardly inclined to the direction of the flue gas stream 7 into the latter.

In the arrangements shown in FIGS. 6–9, annular nozzle boxes 9′, 9″ or 9‴ are provided along the wall 6 of the flue 4.

Figure 6:
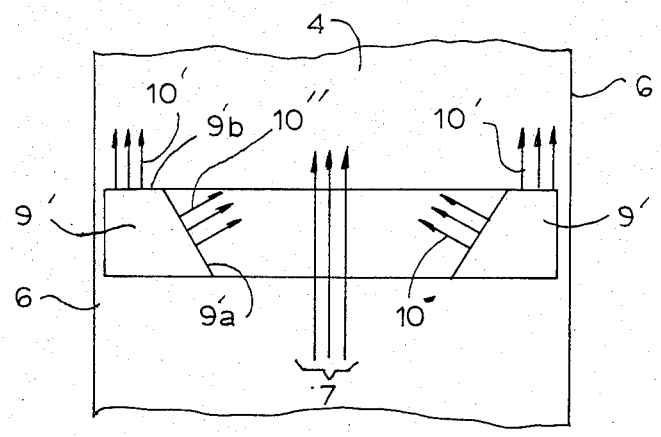
FIGS. 6–9 show different modifications of nozzle boxes arranged in the transition zone between the combustion chamber and the flue of the incinerator.

The nozzle box 9′ shown in FIG. 6 has an upper wall 9′*b*, substantially normal to the wall 6 of the flue 4, and an annular inner wall 9′*a* extending downwardly and inwardly inclined from an inner edge of the upper wall 9′*b*. A first plurality of nozzles are provided in the upper wall 9′*b* oriented to direct air streams 10′ at high speed in upward direction and substantially parallel to the wall 6 of the flue, and a second plurality of nozzles is provided in the inner wall 9′*a* oriented to direct air streams 10″ at high speed in a direction substantially normal to the inner wall 9′*a* into the stream 7 of flue gas.

Figure 7:
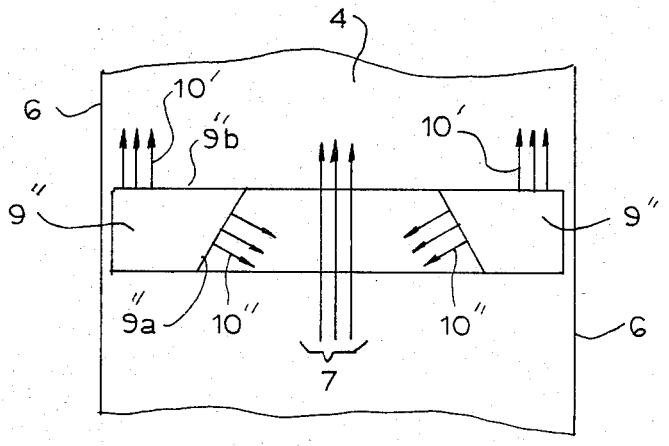

The nozzle box 9″ shown in FIG. 7 has also a trapezoidal cross-section and an upper wall 9″*b* substantially normal to the wall 6 of the flue and an inner wall 9″*a* extending downwardly and outwardly inclined from an inner edge of the upper wall. A first plurality of nozzles is provided in the wall 9″*b*, oriented to direct air streams 10′ at high speed in upward direction and substantially parallel to the wall 6 of the flue, and a second plurality of nozzles is provided in the inner wall 9″*a*, oriented to direct air streams 10″ at high speed in a direction substantially normal to the inner wall into the stream 7 of flue gas.

Figure 8:
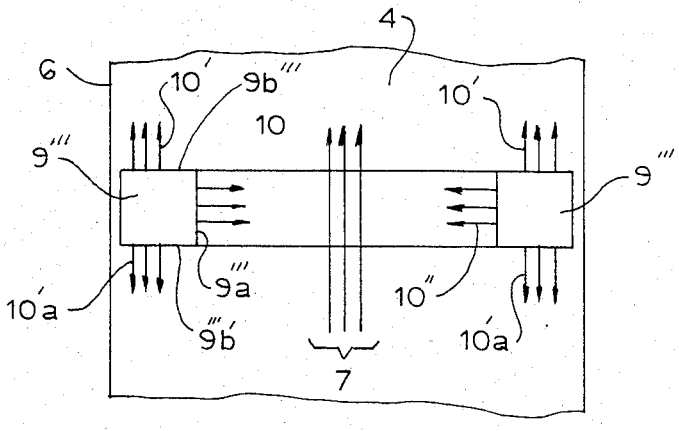

In the embodiment shown in FIG. 8, the likewise annular nozzle box 9‴ has a rectangular or quadrangular cross-section, and the upper wall 9‴*b* extending normal to the wall 6 of the flue is provided with a first plurality of nozzles oriented to direct air streams 10′ at high speed in upward direction parallel to the wall 6 of the flue, whereas the bottom wall 9‴*b* is provided with a second plurality of nozzles, oriented to direct air streams at high speed 10*a*′ in downward direction substantially parallel to the wall 6 of the flue, and a third plurality of nozzles is provided in the inner wall 9‴*a*, oriented to direct air streams at high speed in direction substantially normal to this inner wall into the stream of flue gas 7.

Figure 9:
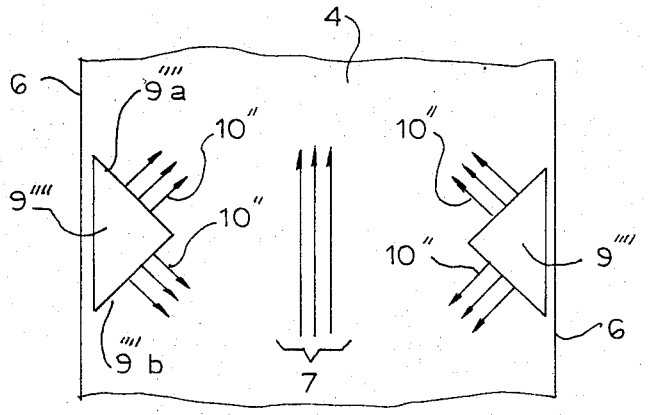

Finally, in the embodiment shown in FIG. 9, there are two nozzle boxes 9⁗ arranged opposite each other in the flue 4, and these nozzle boxes are of triangular cross-section with one of the walls thereof parallel and engaging the opposite wall 6 of the flue 4, whereas the two other inclined walls 9⁗*a* and 9⁗*b* are each provided with a plurality of nozzles oriented to direct air streams 10″, respectively in upward and in downward direction inclined at an acute angle to the stream of glue gas 7 into the latter.

With respect to the embodiments shown in FIGS. 6–8 it is to be understood that nozzles for providing the air streams are provided all around the annular nozzles on the respective walls thereof, while this is not shown for drawing simplicity in the aforementioned FIGS. 6–8.

It will be understood that each of the elements described above, or two or more together, may also find a useful application in other types of garbage incinerators differing from the types described above.

While the invention has been illustrated and described as embodied in a garbage incinerator provided with nozzle boxes in the flue for directing secondary air streams along the flue wall and additional air streams in a direction transverse to the flue gases passing through the flue, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a garbage incinerator, comprising a combustion grate, inlet passage means for feeding garbage onto said combustion grate, wall means forming a combustion chamber above said grate and an upwardly projecting flue connected to said combustion chamber so that a stream of flue gases passes from said combustion chamber through said flue; the improvement comprising nozzle box means for blowing secondary air streams at high speed into said stream of flue gas, said wall means further including a transition zone between said combustion chamber and said flue, said nozzle box means being positioned within said wall means and in said transition zone, said nozzle box means being provided with blower means for supplying secondary air into said nozzle box means, said nozzle box means extending horizontally over the entire width of said combustion chamber and including a plurality of nozzles distributed over the entire length of said nozzle box means and being closely arranged relative to each other, at least some of said nozzles having axes being oriented to direct air streams at high speed, in a direction transverse to the stream of flue gases.

2. The incinerator as defined in claim 1, wherein said nozzle box means includes at least one side formed with said nozzles, said nozzles being arranged on said side in two rows, the nozzles in said two rows being offset relative to each other so that the distance between adjacent nozzles in each row is at most equal to the diameter of each nozzle.

3. A garbage incinerator as defined in claim 1, wherein said nozzle box means has a first plurality of nozzles oriented to direct air streams at high speed in a direction transverse to the stream of flue gas and a second plurality of nozzles to direct air streams at high speed in a direction substantially parallel to the wall means forming said flue.

4. A garbage incinerator as defined in claim 1, wherein said wall means form at the transition zone between said combustion chamber and said flue at least one nose-like protrusion having an upwardly inclined face, and wherein said nozzle box means is arranged adjacent to said protrusion and having a first plurality of nozzles oriented to direct air streams at high speed in upward direction along said upwardly inclined face and a second plurality of nozzles oriented to direct air streams at high speed in a direction transverse to said first mentioned streams into said stream of flue gas.

5. A garbage incinerator as defined in claim 1, wherein said wall means form at the transition zone between said combustion chamber and said flue a nose-like protrusion having an upwardly inclined face, and wherein said nozzle box means is arranged above and adjacent to said inclined face and having a first plurality of nozzles oriented to blow air streams at high speed in downward direction substantially parallel to said inclined face and a second plurality of nozzles oriented to blow air streams at high speed in a direction transverse to said first-mentioned air streams into said stream of flue gas.

6. A garbage incinerator as defined in claim 1, wherein nozzle box means is annular and is positioned substantially in a plane normal to said upwardly extending flue, said nozzle box means having a first plurality of nozzles oriented for directing air streams at high speed substantially parallel to the upwardly extending wall of said flue and a second plurality of nozzles oriented to direct air streams at high speed transverse to the first-mentioned air streams into said stream of flue gas.

7. A garbage incinerator as defined in claim 6, wherein said nozzle box means has a trapezoidal cross-section and a lower wall substantially normal to said flue and an inner wall extending downwardly and inwardly inclined toward said lower wall.

8. A garbage incinerator as defined in claim 6, wherein said nozzle box means has a trapezoidal cross-section and an upper wall substantially normal to the wall of the flue and an inner wall extending downwardly and inwardly inclined from an inner edge of said upper wall, the first plurality of nozzles being provided in said upper wall oriented to direct air streams at high speed in upward direction and substantially parallel to the wall of the flue and the second plurality of nozzles being provided in said inner wall oriented to direct air streams at high speed in a direction substantially normal to said inner wall into said stream of flue gas.

9. A garbage incinerator as defined in claim 5, wherein said nozzle box means has a trapezoidal cross-section and an upper wall substantially normal to the wall of said flue and an inner wall extending downwardly and outwardly inclined from an inner edge of said upper wall, the first plurality of nozzles being provided in said upper wall oriented to direct air streams at high speed in upward direction and substantially parallel to the wall of the flue and the second plurality of nozzles being provided in said inner wall oriented to direct air streams at high speed in a direction substantially normal to said inner wall into said stream of flue gas.

10. A garbage incinerator as defined in claim 6, wherein said nozzle box means has a rectangular cross-section having a top wall and a bottom wall substantially normal to the wall of the flue and an inner wall, the first and the second plurality of nozzles being respectively provided in said top and said bottom wall oriented to direct air streams at high speed respectively in upward and downward directions substantially parallel to said flue, and a third plurality of nozzles being provided in said inner wall oriented to direct air streams at high speed in a direction substantially normal to said inner wall into said stream of flue gas.

11. A garbage incinerator as defined in claim 1, wherein two nozzle box means are arranged in said transition zone opposite each other, each of said nozzle box means having a triangular cross-section with one wall abutting against a wall of the flue, and a first and a second plurality of nozzles being provided in other walls of the nozzle box means and oriented to direct air streams at high speed respectively normal to the other walls into the stream of flue gas.

12. A garbage incinerator as defined in claim 1, wherein said nozzle box means comprise at least one hollow body of heat- and pressure-resistant material.

13. A garbage incinerator, comprising a combustion grate; inlet passage means for feeding garbage onto said combustion grate; wall means forming a combustion chamber above said grate; an upwardly projecting flue connected to said combustion chamber so that a stream of flue gases passes from said combustion chamber through said flue; nozzle means for blowing secondary air streams at high speed into said stream of flue gas, said wall means further including a transition zone between said combustion chamber and said flue, said nozzle means being positioned within said wall means and in said transition zone, said nozzle means being provided with blower means for supplying secondary air into said nozzle box means, said nozzle means including at least one elongated hollow box-shaped member having an axis of elongation extending horizontally, said member projecting over the entire width of said combustion chamber and including a plurality of nozzles distributed over the entire length thereof and being closely arranged relative to each other, at least some of said nozzles having axes being oriented to direct air streams at high speed, in a direction transverse to the stream of flue gases.

14. The incinerator as defined in claim 13, wherein said member includes at least one side formed with said nozzles, said nozzles being arranged on said side in two rows, the nozzles in said two rows being offset relative to each other so that the distance between adjacent nozzles in each row is at most equal to the diameter of each nozzle.

15. The incinerator as defined in claim 13, wherein said member has a first plurality of nozzles oriented to direct air streams at high speed in a direction transverse to the stream of flue gas and a second plurality of nozzles oriented to direct air streams at high speed in a direction substantially parallel to the wall means forming said flue.

16. The incinerator as defined in claim 13, wherein said wall means form at the transition zone between said combustion chamber and said flue at least one nose-like protrusion having an upwardly inclined face, and wherein said nozzle means is arranged adjacent to said protrusion, said member having a first plurality of nozzles oriented to direct air streams at high speed in upward direction along said upwardly inclined face and a second plurality of nozzles oriented to direct air streams at high speed in a direction transverse to said first mentioned streams into said stream of flue gas.

17. The incinerator as defined in claim 13, wherein said wall means form at the transition zone between said combustion chamber and said flue a nose-like protrusion having an upwardly inclined face, and wherein said nozzle means is arranged above and adjacent to said inclined face, said member having a first plurality of nozzles oriented to blow air streams at high speed in downward direction substantially parallel to said inclined face and a second plurality of nozzles oriented to blow air streams at high speed in a direction transverse to said first-mentioned air streams into said stream of flue gas.

18. The incinerator as defined in claim 13, wherein member is annular and is positioned substantially in a plane normal to said upwardly extending flue, said member having a first plurality of nozzles oriented for directing air streams at high speed substantially parallel to the upwardly extending wall of said flue and a second plurality of nozzles oriented to direct air streams at high speed transverse to the first-mentioned air streams into said stream of flue gas.

19. The incinerator as defined in claim 18, wherein said member has a trapezoidal cross-section and a lower wall substantially normal to said flue and an inner wall extending downwardly and inwardly inclined toward said lower wall.

20. A garbage incinerator as defined in claim 18, wherein member has a trapezoidal cross-section and an upper wall substantially normal to a wall of the flue and an inner wall extending downwardly and inwardly inclined from an inner edge of said upper wall, the first plurality of nozzles being provided in said upper wall and being oriented to direct air streams at high speed in upward direction and substantially parallel to the wall of the flue and the second plurality of nozzles being provided in said inner wall and being oriented to direct air streams at high speed in a direction substantially normal to said inner wall into said stream of flue gas.

21. The incinerator as defined in claim 17, wherein said member has a trapezoidal cross-section and an upper wall substantially normal to a wall of said flue and an inner wall extending downwardly and outwardly inclined from an inner edge of said upper wall, the first plurality of nozzles being provided in said upper wall and being oriented to direct air streams at high speed in upward direction and substantially parallel to the wall of the flue, and the second plurality of nozzles being provided in said inner wall and being oriented to direct air streams at high speed in a direction substantially normal to said inner wall into said stream of flue gas.

22. A garbage incinerator as defined in claim 18, wherein said member has a rectangular cross-section having a top wall and a bottom wall substantially normal to a wall of the flue and an inner wall, the first and the second plurality of nozzles being respectively provided in said top and said bottom wall and being oriented to direct air streams at high speed respectively in upward and downward directions substantially parallel to said flue, and a third plurality of nozzles being provided in said inner wall and being oriented to direct air streams at high speed in a direction substantially normal to said inner wall into said stream of flue gas.

23. A garbage incinerator as defined in claim 13, wherein two such box-shaped members are arranged in said transition zone opposite each other, each of said members having a triangular cross-section with one wall abutting against a wall of the flue, and a first and a second plurality of nozzles being provided in other walls of the nozzle box means and being oriented to direct air streams at high speed respectively normal to the other walls into the stream of flue gas.

24. A garbage incinerator as defined in claim 13, wherein said member is made of heat- and pressure-resistant material.

* * * * *